United States Patent [19]

Zepeda-Castillo, deceased et al.

[11] 4,138,272

[45] Feb. 6, 1979

[54] PROCESS FOR THE OBTENTION OF FRUCTOSE AND FRUCTOSE-RICH SYRUPS FROM XEROPHYTE PLANTS

[76] Inventors: Enrique Zepeda-Castillo, deceased, late of Jalisco, by Isaura N. Vda, de Zepeda, executrix, Juan Bernardino 249, Guadalajara 5, Jalisco, Mexico

[21] Appl. No.: 851,657

[22] Filed: Nov. 15, 1977

[51] Int. Cl.[2] ..... C13C 1/00; C13D 3/02; C13K 11/00

[52] U.S. Cl. ..... 127/37; 127/43; 127/48

[58] Field of Search ..... 127/37, 43, 48

[56] References Cited

U.S. PATENT DOCUMENTS

| | | | |
|---|---|---|---|
| 3,218,188 | 11/1965 | Lippe et al. | 127/43 |
| 3,489,742 | 1/1970 | Gerall | 127/37 X |
| 3,640,768 | 2/1972 | Eickenmeyer | 127/37 |
| 3,928,121 | 12/1975 | Zepeda-Castillo | 127/37 X |

*Primary Examiner*—Morris O. Wolk
*Assistant Examiner*—Michael S. Marcus
*Attorney, Agent, or Firm*—Sughrue, Rothwell, Mion, Zinn and Macpeak

[57] ABSTRACT

A process for the obtention of fructose and fructose-rich syrups from xerophyte plants, particularly of the genus Amarillidaceae, such as Agave, comprises separately collecting the plant material consisting of the leaf portions and the core portions of the plant; admixing and washing with water said plant materials; chopping the washed plant material to form small pieces and recovering the juices released by the chopping operation; subjecting the chopped material to an extraction process with an aqueous liquor expressing the residual solid plant material to expel the enriched extractant therefrom; admixing the plant juice and extractant to obtain a mixed juice, settling and clarifying said mixed juice; acidulating the liquid phase of the process at a preselected moment in the sequence, such that the settled and clarified juice will be brought to a pH of from about 3 to about 4; allowing said acidulated liquid phase to stand for a period of time of from about 2 to 3 hours at a temperature of from about 85° C. to the boiling point; neutralizing the acidulated juice, clarifying the filtered and neutralized juice, heating the clarified and filtered juice, concentrating the heated juice by evaporation; pasteurizing the concentrated juice whereby to obtain a fructose-rich syrup; and crystallizing said fructose-rich syrup to recover crystallized fructose therefrom.

11 Claims, 2 Drawing Figures

PROCESS FOR THE OBTENTION OF FRUCTOSE AND FRUCTOSE-RICH SYRUPS FROM XEROPHYTE PLANTS

BACKGROUND OF THE INVENTION

The present invention refers to a process for the preparation of fructose and fructose-rich syrups suitable for human consumption, from whole raw xerophyte plants and, more particularly, it is related to a process for the obtention of fructose and fructose-rich syrups for human consumption from raw xerophyte plants without having resource to the traditional cooking process, whereby to render the bagasse obtained suitable for the obtention of alpha-cellulose.

In the conventional process used through many years to manufacture distilled liquors of the type of tequila from the fermented juices of xerophyte plants, particularly of the genus Agave, such as *Agave tequilana,* it was mandatory to subject only the core portions of the Agave plant to an intensive cooking step at high temperatures and pressures in order to brake down the cellulosic walls of the plant material for the purpose of facilitating the removal of the juices contained therein by means of suitable expelling process. This cooking step, however, generated substantial amounts of partially carbonized matter which was entrained in a colloidal state in the liquors thus considerably affecting the quality of the liquor expressed. Also, said cooking step produced serious scorching, discoloration, impurification and hardening of the fibrous material, whereby said material had to be considered as practically useless for the obtention of good quality fibers and cellulose.

Despite the very important drawbacks introduced in the process of treating xerophyte plants by the cooking stage which had been considered indispensable heretofore, manufacturers of alcoholic beverages of the above mentioned type had not been able to avoid the use of said cooking step, inasmuch as otherwise it was not possible to achieve a complete extraction of the juices contained in the plant material for further treatment by fermentation and distillation to obtain said liquors.

The colloidal impurities introduced in the expelled juices by virtue of the cooking step, prevented the obtention of juices suitable for being concentrated to form highly concentrated juices or syrups that could be thereafter spray dried to obtain fermentable powders, whereby the possibilities of locating the plants for manufacturing distilled liquors were restricted by economical considerations only to those zones which were in the neigborhood of the regions in which said xerophyte plants were grown, as transportation of the whole plants to remote locations was absolutely uneconomical.

On the other hand, the transportation of liquid juices could not be effected for economical reasons and storage of concentrated syrups obtained therefrom was materially impossible because said syrups were highly unstable, whereby they suffered autogenous fermentation in relatively short periods of time, which prevented its massive transportation at long distances.

In U.S. Pat. No. 3,928,121, patented Dec. 23, 1975 to the same applicant, a process for the obtention of fermentable powdered syrups and alpha-cellulose from xerophyte plants is disclosed, that fully overcomes the above mentioned problems, by avoiding the cooking step and replacing the same with a novel extraction stage which was effected by means of an aqueous liquor at a temperature of from 85 to 92° C, with which the extraction of the juices from the plant material was effected in a highly efficient manner, thus avoiding the contamination of the juices with colloidal matter generated by the said cooking step. This method therefore permitted the production of highly concentrated syrups capable of being spray dried to obtain fermentable powders and also permitted the production of highly pure alpha-cellulose, inasmuch as the scorching and hardening of the bagasse, caused by the cooking step, were no longer existant in the process.

The concentrated syrups obtained by means of the process of U.S. Pat. No. 3,928,121, while containing important concentrations of fructose, however, resisted any attempt to crystallize the same for the recovery of said important food product, for reasons that are not clearly understood up to the present date. Therefore, the syrups obtained by the said process were only suitable for being either directly fermented to be converted into distilled liquors or for being spray dried to form fermentable powders which only use was to also obtain alcoholic liquors upon rehydration thereof, fermentation and distillation. In other words, the syrups obtained by the process of U.S. Pat. No. 3,928,121 could not be subjected to crystallization to obtain crystallized fructose and were not in themselves apt for direct human consumption in substitution of the very well known sweetening syrups obtained from grains such as corn and the like.

Therefore, while the process of U.S. Pat. No. 3,928,121 represents a breakthrough in itself, because a very important advance in the art of processing xerophyte plants was provided thereby, any attempt to obtain pure fructose by crystallization and any attempt to render the concentrated syrup of said process suitable for direct human consumption for sweetening purposes, were rather fruitless in view of the fact that, for reasons not understood, said syrups could only be spray dried but not crystallized to recover the pure sugar.

BRIEF SUMMARY OF THE INVENTION

It has been now surprisingly found that by acidulating the liquid phase of the process at any predetermined stage thereof with a suitable strong acid, in order to obtain a settled and clarified juice having a pH of from about 3 to about 4 and allowing to stand the acidulated settled and clarified juice at a temperature of from about 85° C.to the boiling point thereof for about 2 to 3 hours, the concentrated syrup obtained after evaporation has a considerably increased content of fructose and shows easily crystallizable characteristics, whereby said syrups are rendered quite suitable for direct human consumption and can also be crystallized to obtain the crystallized sugar in a highly pure state.

Therefore, it is an object of the present invention to provide a process for the obtention of fructose and fructose-rich syrups from xerophyte plants which will permit the processing of the whole xerophyte plant material, will overcome all the disadvantages of the prior art processes and will at the same time be of a highly economical performance.

Another object of the present invention is to provide a process of the above mentioned character, which will make use of the uncooked xerophyte plant material for the obtention of fructose and fructose-rich syrups, as well as for producing a pure bagasse suitable for being used as a raw material for the obtention of alpha-cellulose.

It is a further object of the present invention to provide a process for the obtention of fructose and fructose-rich syrups, of the above mentioned character, in which both the leaf and the core portions of xerophyte plants will be fully processed without the need of any cooking step.

A still further object of the present invention is to provide a process of the above mentioned character, which will provide for the obtention of a highly concentrated syrup suitable for direct human consumption for sweetening purposes and showing easily crystallizable characteristics, thus enabling the efficient obtention of pure crystallized fructose.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of specific embodiments, when read in connection with the accompanying drawings, in which:

DETAILED DESCRIPTION

Figure 1:
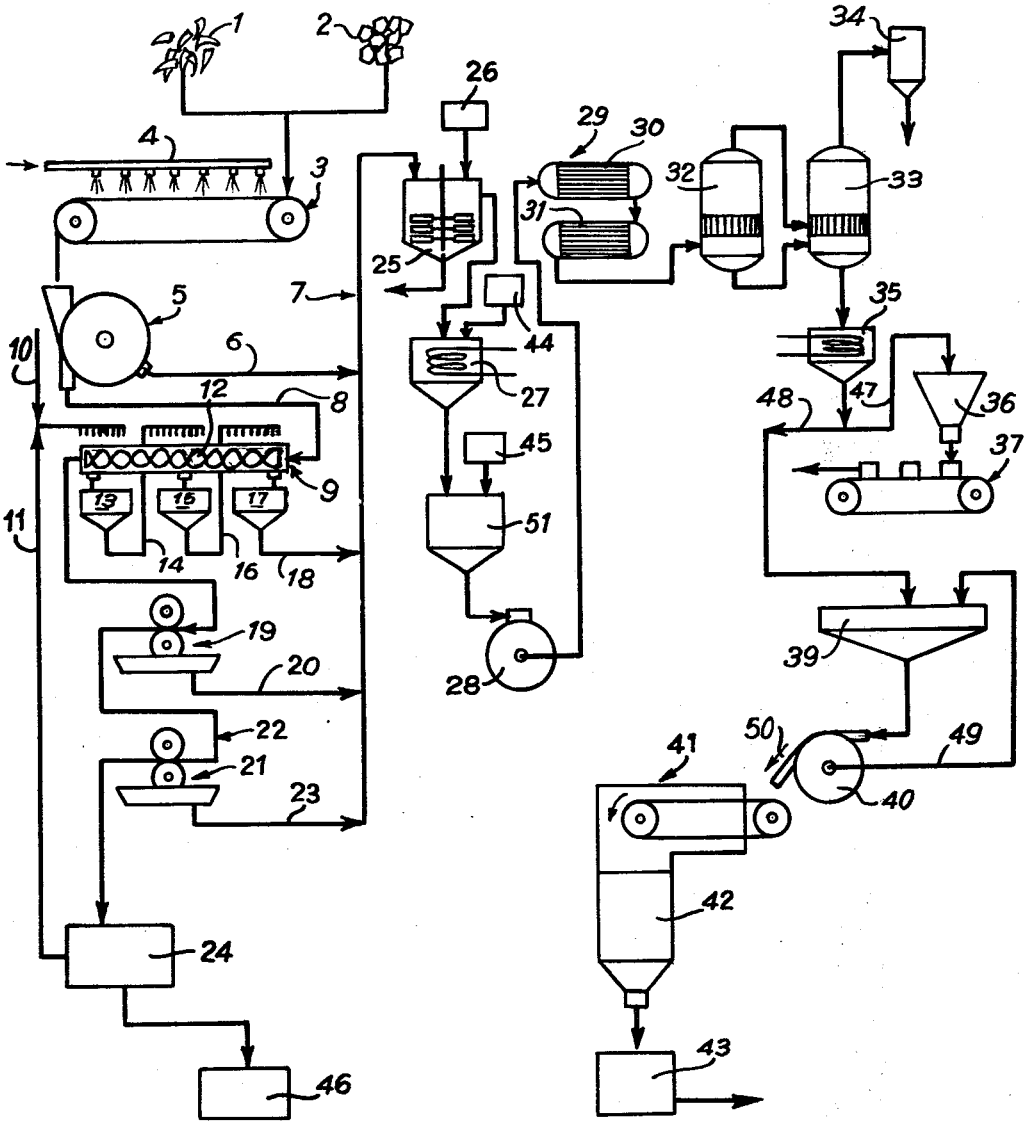
FIG. 1 is a schematical flow sheet of the process for the obtention of fructose and fructose-rich syrups from xerophyte plants in accordance with a first embodiment of the present invention.

Having now more particular reference to the drawings, wherein throughout the figures similar parts are designated by like reference characters whenever possible, the process of the present invention is illustrated in terms of two different preferred embodiments thereof. It must be understood, however, that said embodiments are not to be construed as restrictive of the scope of the present invention, inasmuch as certain steps of the process may be varied within the skillfulness of any expert chemist, without thereby departing from the true scope and spirit of the invention which is merely exemplified by said embodiments illustrated in the accompanying drawings.

While any type of xerophyte plant can be subjected to the process which will be described in detail hereinbelow, upon introducing irrelevant modifications in the different steps thereof, the present invention will best be understood by having reference to a preferred illustrative example in which a xerophyte plant of the genus Amarillidaceae, such as *Agave tequilana* or *Agave americana* is used, said plants normally containing from 62 to 63% by weight of core material, from 30 to 32% by weight of pulpy leaf material, from 2 to 3% of stalk material and from 2 to 6% of root material.

Having now more particular reference to the above mentioned accompanying drawings, the whole of the core portion and the leaf portion of this type of plants is used, namely, a total of about from 92 to 95% of the whole plant material, whereby, upon cutting the plants, said leaf material and said core material are removed from the remainder and are separately stored, such as illustrated at 1 and 2 in the drawings, and suitable proportions of each of said plant materials are fed to the process in order to maintain the proper Brix value of the mixed juice, within suitable preestablished limits.

Having now more particular reference to the embodiment illustrated in FIG. 1 of the drawings, the process in accordance with said embodiment comprises feeding the cores and leaves of the xerophyte plants to a washing section 3 wherein the plant material is subjected to an energetic water spray from line 4 in order to thoroughly wash the surface of said plant material to remove any foreign matter which might affect the performance of the following steps of the process.

The suitably washed xerophyte plant material is then chopped by any suitable means, such as a mechanical chopper 5, to form pieces of a suitable small size, preferably of from 1 to 3 cm long, 0.5 to 1.5 cm wide and 0.3 to 0.8 cm thick and more particularly to form pieces of approximate dimensions of $2\times1\times0.5$ cm, inasmuch as these size shows the best results in the extraction step which will be described in more detail hereinbelow, used to substitute the traditional cooking operation to break down the cellulosic walls of the plant material considered necessary in accordance with the prior art and deviced by applicant in accordance with the disclosure contained in U.S. Pat. No. 3,928,121 mentioned above.

The plant juices and the chopped plant material are separated from each other by releasing the juices from the chopped xerophyte plant material and the juices are sent through a suitable line 6 to a line 7 leading to a suitable mixed juice tank 25.

The chopped material is fed, by suitable conveyor means 8, to an extractor 9 wherein it is subjected to an extraction process with an aqueous extractant liquor in order to extract the solids dissolved in the water contained in said chopped plant material.

While the extraction step mentioned above, in accordance with the embodiment shown in FIG. 1 of the drawings, may be effected by using pure water fed through line 10 at a temperature preferably between 85 and 92° C, it is generally preferred to use the aqueous liquid of line 11, obtained from the hydrolysis of the bagasse which is carried out in the known cellulose process illustrated by means of the block 24, which will not be described in view of the fact that this portion of the process does not form part of the present invention. As this aqueous hydrolysis liquor already contains small amounts of dissolved materials, a more complete stripping of the cellulosic plant material is achieved by the utilization of the thus formed diluted hydrolysis liquor for the extraction step of the process in accordance with the first embodiment of this invention. When the hydrolysis liquor from the cellulose process is not produced in amounts sufficient to replenish the necessary amounts of the extractant lost from the extraction operation, then said amounts are completed with pure water. The aqueous liquor, regardless of its composition, is maintained at the above mentioned temperature of from 85 to 92° C, by means of steam or any other heating source, as this temperature is critical for the operation of the extractor 9.

In the preferred extraction system in accordance with the present invention, the chopped plant material is fed through the inlet end of an enclosed elongated conveyor, such as a ribbon conveyor 12, to which said chopped plant material is continuously fed, while at the other end of the conveyor the extractant (10, 11) is fed at the prescribed temperature.

A first extractant tap is provided at the outlet end of conveyor 12 in order to remove a portion of partially enriched extractant down to receiver 13, and the partially enriched extractant is reintroduced into the conveyor 12 at the intermediate portion through line 14, the operation being repeated by tapping the increasingly enriched extractant from the intermediate tap section down to container 15, to be reintroduced through line 16 into the inlet end of the conveyor, whence the enriched extractant produced by the extraction operation is removed through the tap provided near the said inlet end of the conveyor down to the container 17, in order to carry said enriched extractant through line 18, to line 7 leading to the mixed juice tank 25, together with the juice received from the chopping step 5.

The plant material stripped in the extraction step, even when the extraction operation is of a high efficiency when effected in accordance with the above, still tends to retain certain amounts of juice, whereby it is preferably expressed in an expeller 19 to mechanically remove the remainder of the juice from the material, said expelled juice being also introduced into the mixed juice line 7 through line 20.

The above described steps practically remove the whole of the soluble substances from the xerophyte plant material, whereby the process of the present invention achieves the production of a bagasse which, by virtue of not having suffered the effects of a prolonged cooking at elevated temperatures, furnishes a raw fibrous material highly suitable to be used in a cellulose process such as illustrated by means of block 24 to produce alpha-cellulose illustrated by means of the block 46 in FIG. 1 of the drawings.

While the expression of the material from the extraction step can be effected in a single stage, it is preferred to use two expellers 19 and 21, with the introduction of sufficient amounts of water through line 22 upstream of the second expeller, in order to thereby effect in the first expeller 19 a complete recovery of the juice retained by the fibers, while in the second expeller 21, because of the introduction of the water 22, the soluble solids which may have remained in the plant material are completely extracted, said operation being more efficiently effected if the water incorporated through line 22 is maintained at a temperature of from about 80 to 85° C and if said water is fed upstream of said second expeller. The diluted juice obtained from expeller 21 is also fed into line 7 through line 23 as clearly illustrated in FIG. 1 of the drawings.

All the different juices fed through lines 6, 18, 20 and 23 into the mixed juice line 7, are charged into a mixed juice tank 25 wherein said juices are thoroughly mixed and thereafter settled in order to remove any undissolved solid material which could contaminate the same and, if desired, the mixed juice is clarified by means of any suitable technique such as the addition of a flocculant from a flocculant feeder 26, and is thereafter filtered to remove the bagasse still contained therein, if necessary. The flocculated proteins, gums and resins may be stored for further processing or disposal.

The settled and clarified mixed juice is thereafter charged into a suitable container 27 having heating means, wherein said juice is acidulated by the addition of a suitable strong acid from the source 44, in order to bring its pH to a value of from about 3 to about 4, for which purpose it is preferred to use a mineral acid such as hydrochloric, sulfuric or phosphoric acid in view of the low prices of said acids, as well as in view of the fact that no special materials of construction will be required for the acidulating tank 27. The acidulated juice is thereafter heated to a temperature of from about 85° C. to the boiling point of the juice, and is allowed to stand at said temperature for a period of time of from about 2 to about 3 hours, preferably about 2.5 hours, whereby the fructose contained therein is considerably increased for reasons that are not well understood.

The solution thus obtained is thereafter neutralized, for instance, in a neutralizing tank 51 by the addition of caustic soda or lime from a reservoir 45, in order to bring its pH back to a value of from about 6 to about 7. This neutralization step, as will be apparent to any one skilled in the art, may also be effected through the use of ion exchange resins that are very well known in the art. After neutralization, the solution is clarified and filtered through a conventional filter 28.

The filtered and clarified neutralized solution is thereafter fed to preheating system 29 to raise its temperature to about 100° C. The preheating system 29 may be preferably formed by a two-stage preheated, which first stage 30 raises the temperature of the solution to about 60° C. and which second stage 31 raised said temperature to about 100° C. This preheating system, however, may be a single-stage preheater, if the feeding area of the heat exchanger is appropriately selected or if the temperature of the incoming liquid is sufficiently high.

The preheated juice is fed to a multiple effect evaporator, which preferably comprises two effects 32 and 33 and a condenser 34, the preheated juice being received in the first effect 32 with a Brix value of about 10.3 which is raised to about 80° Brix at the outlet of the second effect 33. The concentrated juice or syrup is then received in a pasteurizing tank 35 wherein it is furtherly heat treated and the pasteurized concentrated juice or syrup, having a high content of fructose therein, may be sent to a storage tank 36 through line 47, from which the syrup may be bottled within tight receptacles 38 travelling on a take-off band 37 for being sent to the storage facilities as a final product comprising a fructose-rich syrup suitable for human consumption for sweetening purposes. The sweetening syrup may of course be thereafter subjected to a further pasteurization within the receptacles 38.

The fructose-rich syrup obtained from the pasteurizing tank 35 may also be conducted through a line 48 to crystallizers 39 wherein, by known crystallization techniques such as seeding, controlled cooling and the like, crystallized fructose is obtained. From the crystallizers 39, the mixture of crystals and mother liquor is passed to a centrifuge or suitable filter 40, whence the mother liquor 49 is recycled to the crystallizers 39 and the final moist fructose crystals are discharged from the filter such as at 50, unto a suitable drier 41 to be finally stored in an appropriate bin 42 for further packing within bags or the like 43, which are sent to the storage area of the plant.

Figure 2:
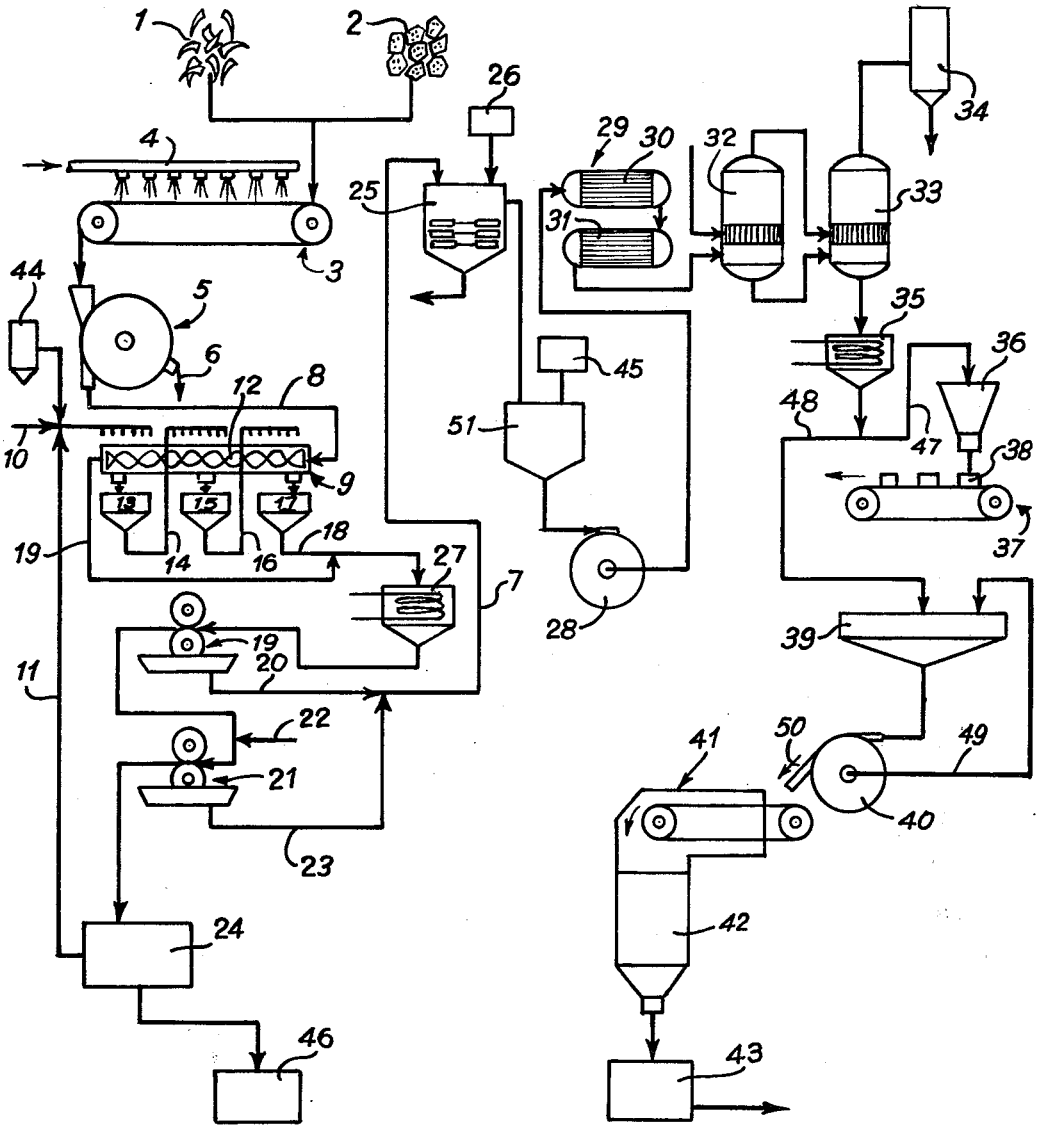
FIG. 2 is a schematical flow sheet similar to FIG. 1, but representing a second embodiment of the process in accordance with the present invention.

In accordance with another preferred embodiment of the process, illustrated in FIG. 2 of the drawings, it will be seen that, in the particular case of this second embodiment, the acidulation is not effected on the settled and clarified juice from the settling tank 25, but rather it is the aqueous liquor 10, 11 used for the extraction operation within the extractor 9 which is acidulated by means of the addition of said acid from tank 44, and the chopped material 6 and juices 8 released by the chopping operation effected at the chopper 5 are admixed and fed together into the inlet end of the extractor 9, from which the enriched extractant 18 and stripped bagasse 19 are again combined and fed together into a heating tank 27, wherein the admixture is left standing for the above mentioned period of from about 2 to 3 hours, preferably 2.5 hours at the also above specified temperature of from about 85° to the boiling point of the mixture, whereby the liquor is enriched in fructose and is thereafter expelled through expeller 19 in order to obtain a fructose enriched acidulated juice which is conducted through lines 20 and 23 into line 7 leading to the settling tank 25 for flocculation and settling purposes, whereas the bagasse is again expelled as described above, in order to produce a raw material suitable for cellulose production. The settled and clarified acidulated juice is then neutralized in tank 51 by the addition of the alkali from reservoir 45 and thereafter the neutralized juice is clarified and filtered through filter 28, to thereafter undergo exactly the same procedural steps described in connection with the embodiment of FIG. 1.

It will be seen from the above description of the two preferred embodiment of the invention that the important characteristic of this process is to maintain a low pH of from about 3 to 4 in the liquid phase of the process, regardless of the fact that the acidulation in order to obtain said pH is effected in the extractant aqueous liquor, in the settled and clarified juice or in any other stage of the process, provided that said acidulation is followed by standing of the mixture for about from 2 to 3 hours at a temperature of from about 85° C. to the boiling point thereof, inasmuch as said steps considerably increase the fructose content of the juice, and render the same easily crystallizable, contrary to the process of U.S. Pat. No. 3,928,121, wherein no crystallizable fructose was obtained in the concentrated syrup produced by the evaporators 32, 33.

Therefore, it will be apparent that a novel process has been provided to produce easily crystallizable concentrated syrups which contain high proportions of fructose, thus permitting the production of crystallized fructose for human consumption as well as fructose-rich syrups also apt for human consumption as sweeteners containing a sugar that shows numerous advantages over the sucrose that is commonly contained in the sweetening syrups of the prior art, inasmuch as it is quite much more easily digestible and has a sweetening power that may be considered to be approximately the same as that of the sucrose containing syrups of the prior art.

Also, the process of the present invention produces a very clean and pure bagasse which may be used as a suitable raw material for the obtention of alpha-cellulose by a process which is well known per se and which has been described in the above mentioned U.S. Pat. No. 3,928,121, in view of the elimination of the cooking step that had been considered as indispensable for processing material from xerophyte plants.

Altough certain specific embodiments of the invention have been shown and described, it is to be understood that many modifications thereof are possible. The invention, therefore, is not to be restricted except insofar as is necessitated by the prior art and by the spirit of the appended claims.

What is claimed is:

1. A process for the obtention of fructose and fructose-rich syrups from xerophyte plants, which comprises: washing the mixed leaf and core material of said plants, chopping the washed plant material to form pieces of a relatively small size and a relatively small amount of plant juice; extracting at least the chopped material with an aqueous extractant at a temperature of between 85 and 92° C. to produce an enriched extractant, expressing the extracted residual solid plant material to expell the remaining enriched extractant and produce an extracted residual solid plant material suitable for use as a raw material in a cellulose process; admixing the enriched extractant streams obtained from the above steps in order to obtain a mixed juice; settling and clarifying said mixed juice to remove the impurifying solids; acidulating a liquid phase of the process at a preselected stage of the sequence such that the thus obtained settled and clarified juice will be brought to a pH of from about 3 to about 4; allowing said acidulated liquid phase to stand for a period of time of from about 2 to about 3 hours, preferably 2.5 hours at a temperature of from about 85° C.to the boiling point thereof; neutralizing the acidulated settled and clarified juice filtering and clarifying the neutralized juice; heating the filtered and clarified neutralized juice to a temperature of about 100° C; concentrating said heated juice by evaporation; pasteurizing said concentrated juice whereby to obtain a fructose-rich sweetener syrup; and crystallizing at least a part of said fructose-rich syrup to recover crystallized fructose therefrom.

2. A process according to claim 1 wherein said washed plant material is chopped to obtain particles having approximate dimensions of from 1 to 3 cm long, 0.5 to 1.5 cm wide and 0.3 to 0.8 cm thick, preferably of dimensions of about $2\times1\times0.5$ cm.

3. A process according to claim 1 wherein the neutralization of said acidulated settled and clarified juice is effected by passing the same through an ion exchange resin.

4. A process according to claim 1 wherein the neutralization of said acidulated settled and clarified juice is effected by the addition of an inorganic base.

5. A process according to claim 4 wherein said inorganic base is selected from caustic soda and lime.

6. A process according to claim 1 wherein the acidulation is effected with a mineral acid.

7. A process according to claim 6 wherein said mineral acid is selected from hydrochloric acid, sulfuric acid and phosphoric acid.

8. A process according to claim 6 wherein said acidulation is effected by adding said acid to the settled and clarified juice; said plant juice being removed from said chopped plant material and admixed with said liquid streams, whereas said chopped plant material is extracted upon removal of said plant juice.

9. A process according to claim 8 wherein said aqueous extractant is an admixture of water and hydrolysis liquor from the hydrolysis step of a cellulose process to which said extracted residual solid plant material is subjected.

10. A process according to claim 6 wherein said acidulation is effected by adding said acid to the aqueous extractant, said plant juice being admixed with said chopped plant material prior to extraction thereof by said acidulated aqueous extractant, said enriched extractant being admixed with said extracted residual solid plant material and allowed to stand with said acidulated liquid phase prior to expressing.

11. A process according to claim 10 wherein said aqueous extractant is an admixture of a strong acid, water and hydrolysis liquor from the hydrolysis step of a cellulose process to which said extracted residual solid plant material is subjected.

* * * * *